US006319038B1

(12) United States Patent
Howell et al.

(10) Patent No.: US 6,319,038 B1
(45) Date of Patent: Nov. 20, 2001

(54) CONTACT FOR CPU SOCKET CONNECTOR

(75) Inventors: David G. Howell, Gilbert, AZ (US); Nick Lin, Hsin-Chuang; Bono Liao, Tu-Chen, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/838,051

(22) Filed: Apr. 18, 2001

(30) Foreign Application Priority Data

Dec. 21, 2000 (TW) ..... 89222269 U

(51) Int. Cl.[7] ..... H01R 4/50
(52) U.S. Cl. ..... 439/342
(58) Field of Search ..... 439/342

(56) References Cited

U.S. PATENT DOCUMENTS 4,422,703 * 12/1983 Christensen et al. ..... 439/266
4,498,725 * 2/1985 Bright et al. ..... 439/347
5,299,950 * 4/1994 Kaneko ..... 439/342
5,443,591 * 8/1995 Tsai ..... 439/342
5,454,727 * 10/1995 Hsu ..... 439/263
5,797,774 * 8/1998 Kaneko ..... 439/857
6,113,412 * 9/2000 Lin ..... 439/342
6,142,810 * 11/2000 Hsiao et al. ..... 439/342

* cited by examiner

*Primary Examiner*—Brian Sircus
*Assistant Examiner*—Thanh-Tam Le
(74) *Attorney, Agent, or Firm*—Wei Te Chung

(57) ABSTRACT

A contact (1) for a CPU socket connector includes a base (10) secured in the connector and a pair of arm sections (20) extending from opposite lateral sides of the base. Each arm section comprises an upper arm (21) extending from a body section (12) of the base, a forearm (25) extending obliquely and upwardly from a free end of the upper arm, a contact region (27) at a free end of the forearm, and a palm (29) extending obliquely from the contact region toward the body section. The pair of forearms defines a first space (251) therebetween, and the pair of palms diverge away from each other and define a second space (291) therebetween. The second space communicates with the first space at a narrow channel (271) defined between the contact regions. A pin (3) of a CPU is adapted to engage with the contact regions and establish electrical connection therebetween.

20 Claims, 6 Drawing Sheets

CONTACT FOR CPU SOCKET CONNECTOR

BACKGROUND OF THE INVENTION

1. Field of the Invention

The present invention relates to a contact for an electrical connector, and particularly to a contact for a CPU (Central Processing Unit) socket connector.

2. Brief Description of the Prior Art

U.S. Pat. No. 4,498,725 discloses a conventional terminal 5 for a CPU socket connector, as is shown in FIG. 6. The terminal 5 comprises a base 50, a soldering tail 52 depending from the base 50, and a pair of arms 51 extending upwardly and rearwardly from the base 50. Forwardly extending palms 55 are connected to the arms 51 by contact regions 53. A distance between the contact regions 53 is greater than that between the palms 55.

A pin of a CPU (not shown) is resiliently clamped between the palms 55 for establishing an electrical connection therebetween. As the palms 55 are cantilevers, their resilience is relatively small. The palms 55 cannot apply sufficient mating force against the pin to ensure reliable engagement between the pin and the palms 55. Thus when the terminal 5 or the pin is subjected to vibration or shock, the pin is sometimes dislodged.

Hence, an improved electrical connector is required to overcome the disadvantage of the prior art. The application Ser. No. 09/792,802 filed on Feb. 23, 2001 having one common inventor and the same assignee with the instant application, discloses one approach which relates to the invention with somewhat extent. Also, U.S. Pat. Nos. 5,299,950, 5,443,591, 5,454,727, 5,797,774 and 4,832,611 were cited as references in the aforementioned copending application.

BRIEF SUMMARY OF THE INVENTION

A main object of the present invention is to provide a contact for a CPU socket connector providing improved mating force against a pin of a CPU.

To achieve the above-mentioned object, a contact for a CPU socket connector in accordance with a first embodiment of the present invention includes a base and a pair of arm sections. The base has a body section adapted to optionally abut against the housing of the connector in the corresponding passageway in which the contact is received, a head section for being secured in the CPU socket connector, and a soldering section for being soldered onto a printed circuit board.

Each arm section includes an upper arm projecting obliquely downwardly from a lateral side of the body section and adapted to optionally abut against the housing of the connector in the corresponding passageway, a forearm extending upwardly from a free end of the upper arm, a contact region at a free end of the forearm, and a palm extending obliquely from the contact region toward the body section. A first space is defined between the forearms. A channel is defined between the contact regions, and within the first space. A second space is defined between the palms, in communication with the first space at the channel. A width of the channel is not only narrower than widths of the first space, but also narrower than widths of the second space. A pin of a CPU is adapted to engage with the contact regions and establish electrical connection therebetween. Since the contact regions are located between the palms and the forearms rather than at free ends of the palms, mating force exerted by the contact regions against the pin is enhanced.

A second embodiment does not have a head section to reduce the possibility of interference with an inserted pin. Accordingly, the arm sections extend beyond an upper limit of the body section.

Other objects, advantages and novel features of the present invention will become more apparent from the following detailed description of the preferred embodiments when taken in conjunction with the accompanying drawings.

DETAILED DESCRIPTION OF THE PREFERRED EMBODIMENTS

Figure 1:
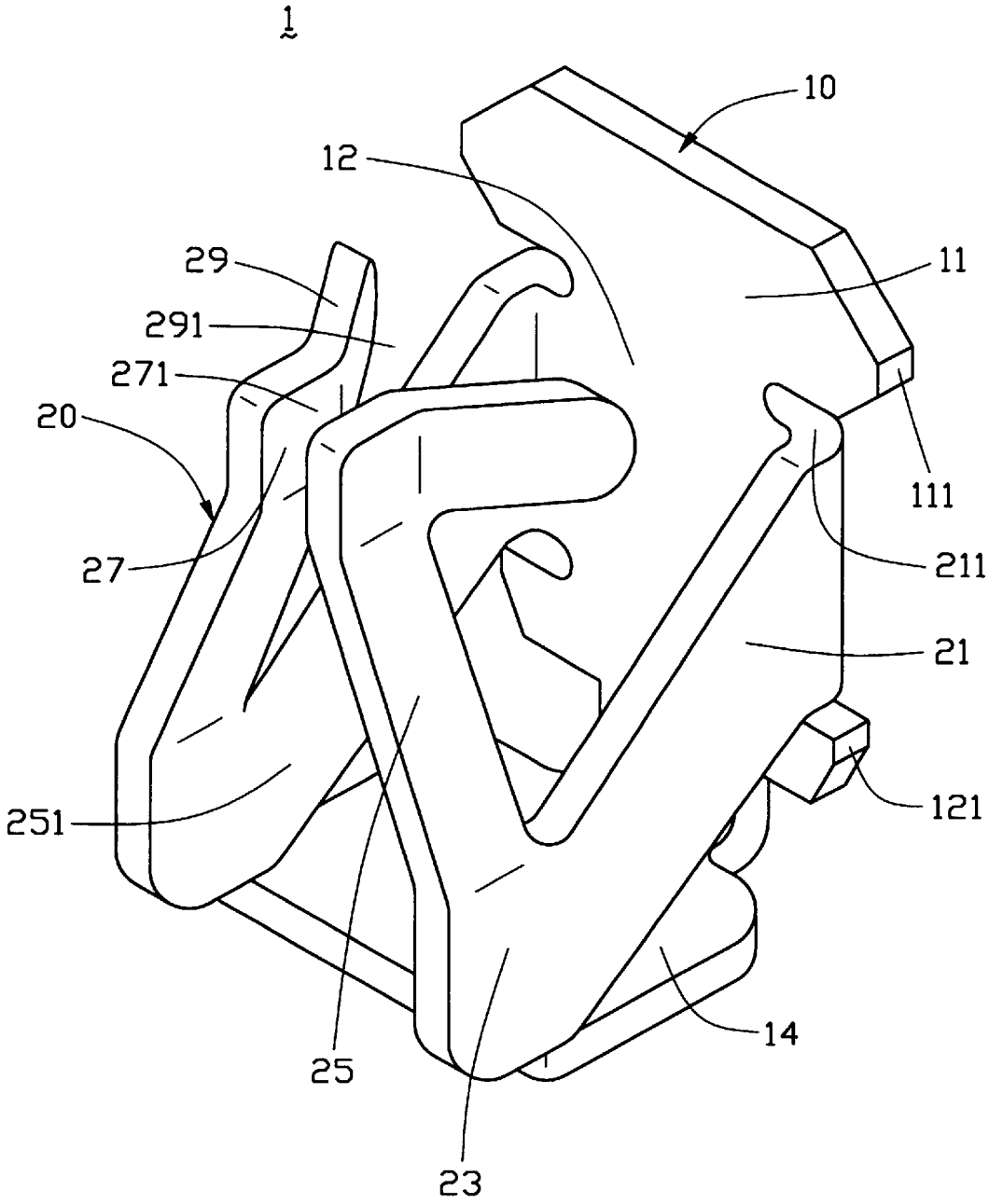
FIG. 1 is a perspective view of a contact for a CPU socket connector in accordance with a first embodiment of the present invention.

Referring to FIG. 1, a metallic contact 1 for a CPU socket connector (not shown) in accordance with a first embodiment of the present invention comprises a base 10 and a pair of arm sections 20 connected to the base 10.

The base 10 includes a body section 12, a head section 11 upwardly projecting from the body section 12, and a soldering section 14 extending perpendicularly from a bottom edge of the body section 12. A pair of upper projections 111 is respectively formed at top portions of opposite lateral edges of the head section 11, and a pair of lower projections 121 is respectively formed at bottom portions of the opposite lateral edges of the body section 12, for interferingly securing the contact 1 in the CPU socket connector. A junction 211 is defined where each arm section 20 meets the body section 12.

Figure 2:
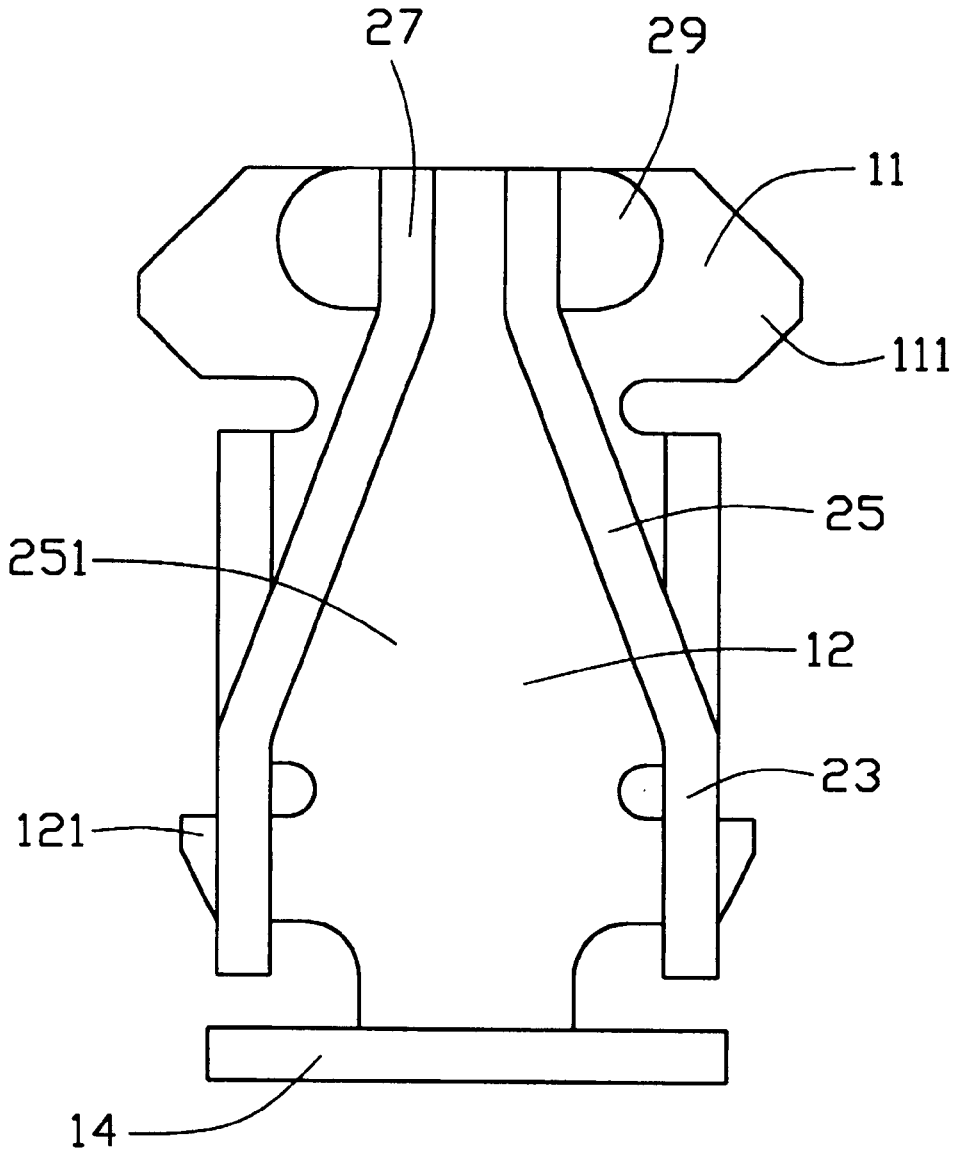
FIG. 2 is a front view of the contact of FIG. 1.
Figure 3:
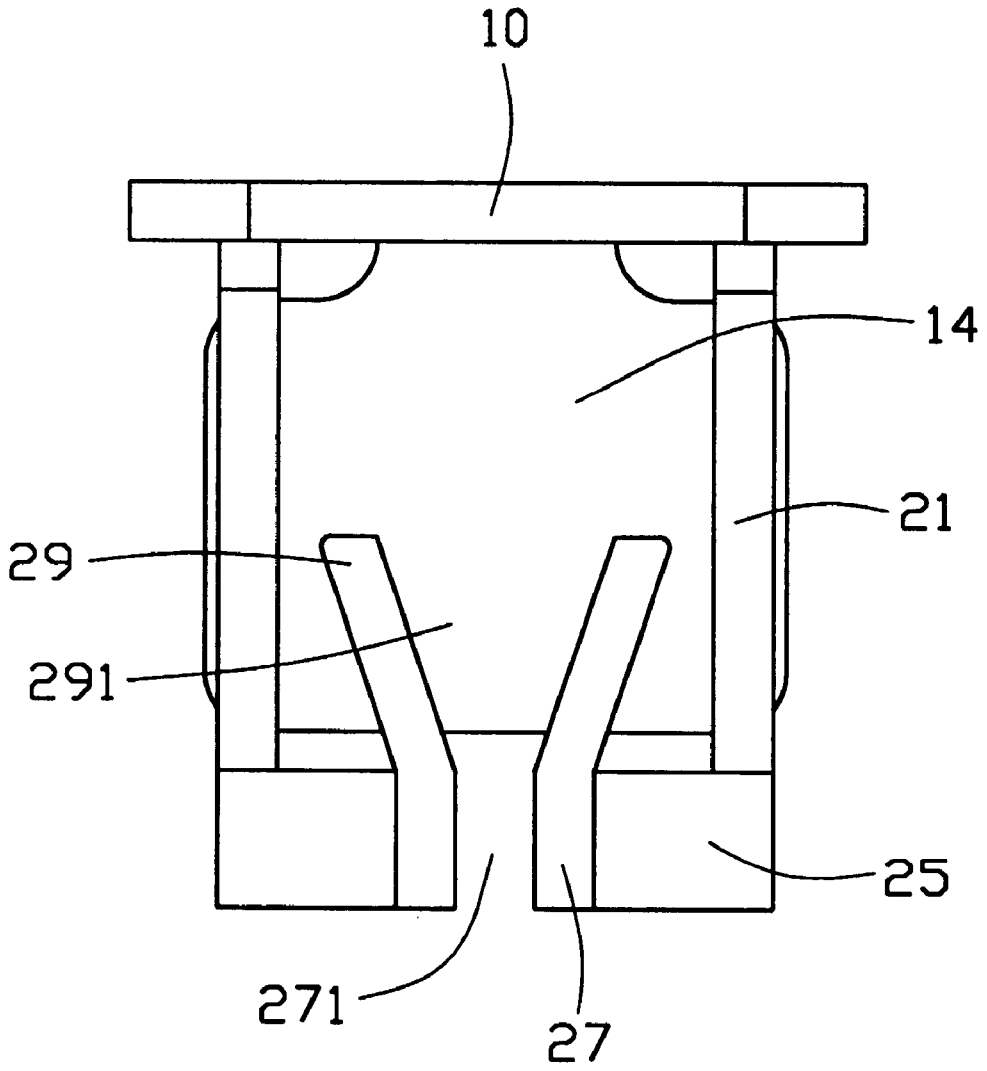
FIG. 3 is a top view of the contact of FIG. 1.
Figure 4:
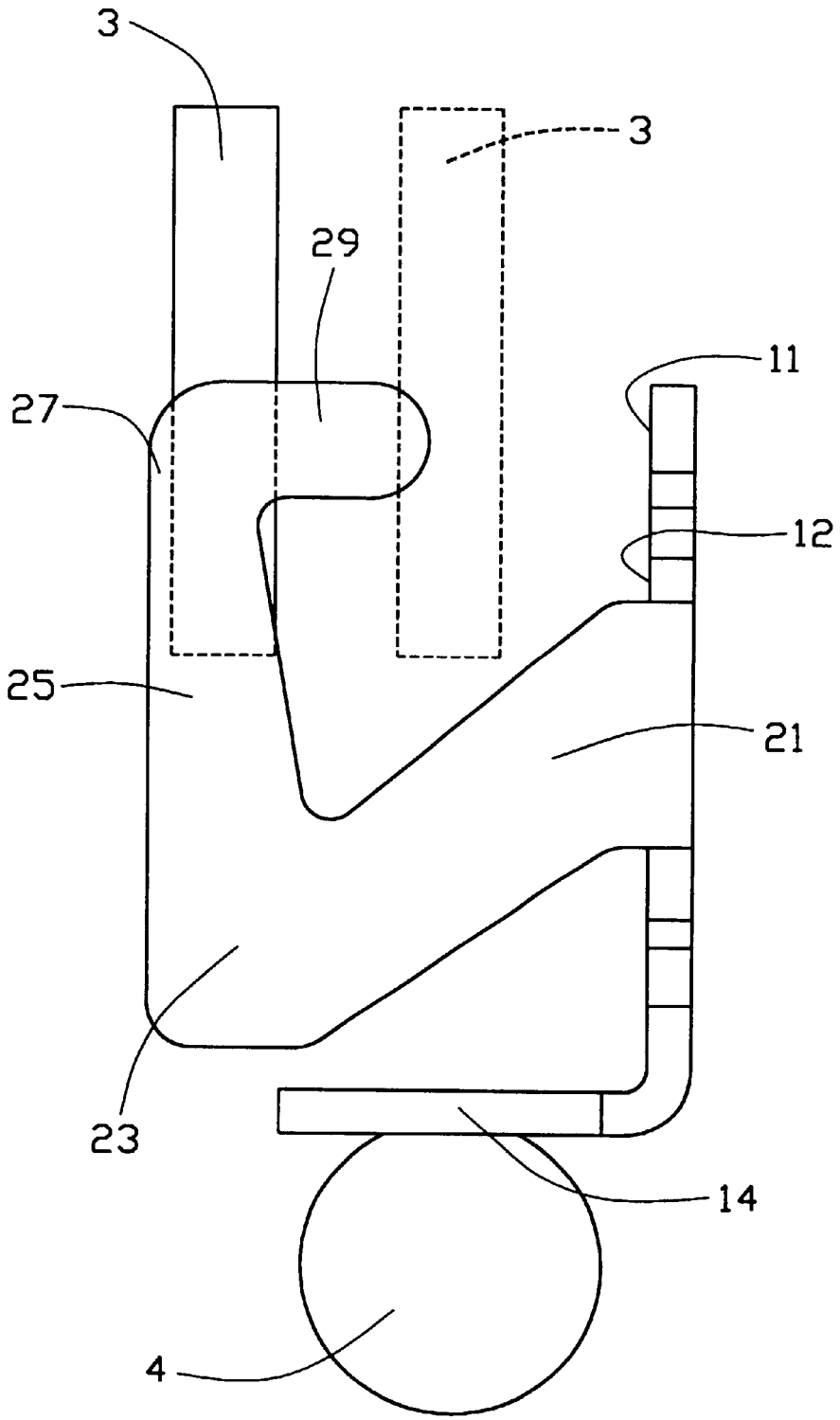
FIG. 4 is a side view of the contact of FIG. 1, together with a soldering ball and an engaging pin of a CPU.

Further referring to FIGS. 2–4, each arm section 20 includes an upper arm 21 extending obliquely downwardly from one lateral edge of the body section 12 toward the soldering section 14, an elbow 23 at a bottom portion of the upper arm 21, a forearm 25 extending obliquely upwardly from the elbow 23, a contact region 27 at a top portion of the forearm 25, and a palm 29 extending obliquely from the contact region 27 toward the body section 12. Each forearm 25 extends from a corresponding elbow 23 toward each other in a direction whose projection in side view is essentially parallel to the body section 12. The forearms 25, elbows 23 and contact regions 27 together define a bellow first space 251. A channel 271 is defined within the first space 251 between the contact regions 27. A second space 291 is defined between the palms 29, in communication with the first space 251 at the channel 271. A portion of the first space 251 between the elbows 23 is wider than portions of the first space 251 between the forearms 25. A portion of the second space 291 between the palms 29 at the contact regions 27 is narrower than portions of the second space 291 between the palms 29 which are closer to the body section 12. The first space 251 and the second space 291 are respectively contained in first and second planes which are perpendicular to each other.

In addition, a distance from the elbows 23 to the palms 29 is substantially equal to a distance from the soldering section 14 to the head section 11. Thus an overall height of the contact 1 is compacted.

As is indicated in FIG. 4, a pin 3 of a CPU engages with the contact 1. The soldering section 14 of the contact 1 is adapted for being soldered onto a printed circuit board (not shown) by a soldering ball 4, for establishing an electrical connection between the pin 3 and an electrical trace of the printed circuit board. Initially, the pin 3 (shown entirely in dotted lines) is guided in the second space 291 by the palms 29, for subsequent engagement with the contact regions 27. The pin 3 is then slid from the second space 291 into the channel 271 and the first space 251 (at which position the pin 3 is shown in unbroken lines in FIG. 4). As a result, the arm sections 20 are outwardly deformed, particularly about the junctions 211. Resilient deformation of the arm sections 20 creates mating forces which ensure that the pin 3 is tightly clamped between the contact regions 29.

Figure 5:
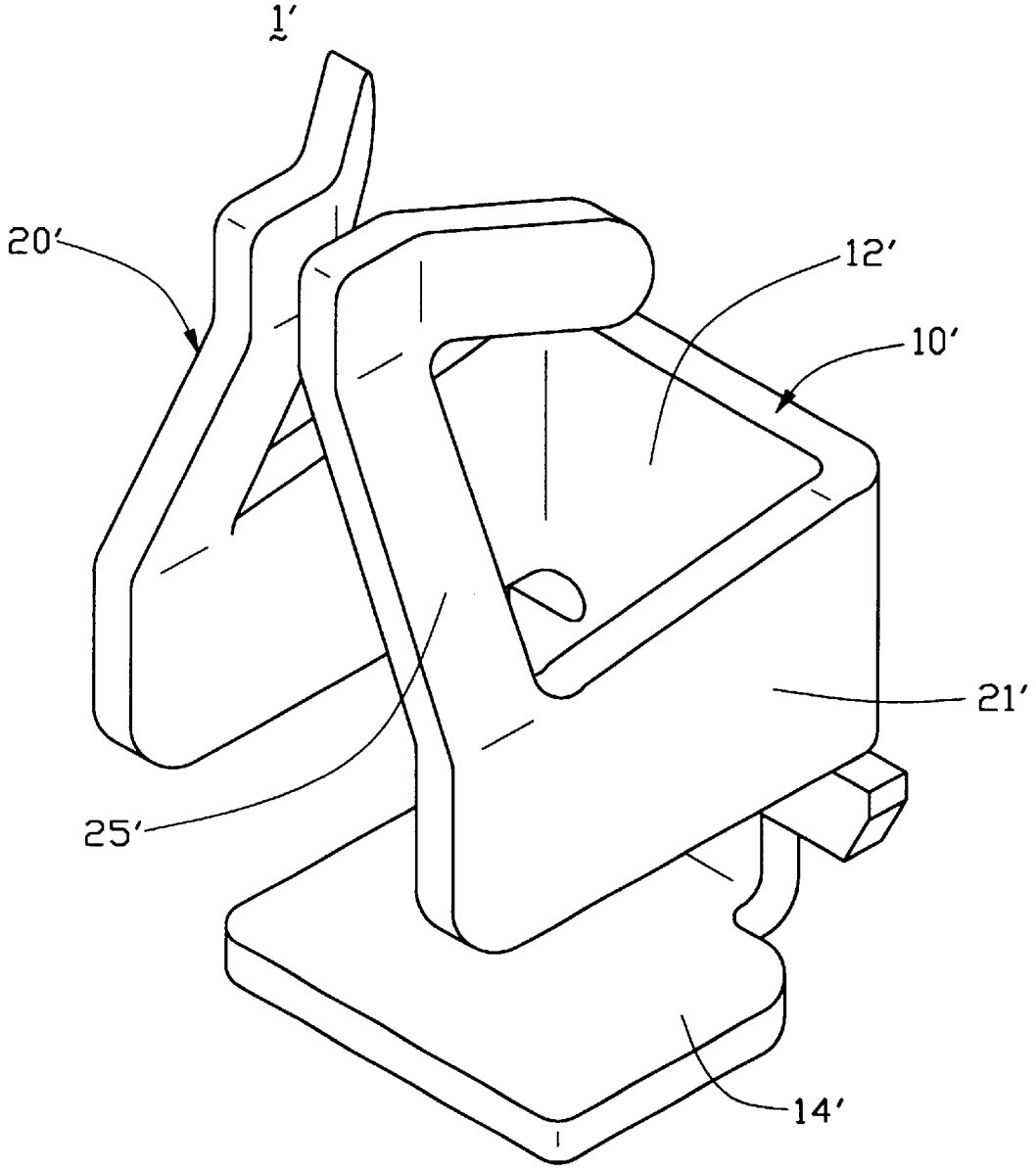
FIG. 5 is a perspective view of a contact for a CPU socket connector in accordance with a second embodiment of the present invention.
Figure 6:
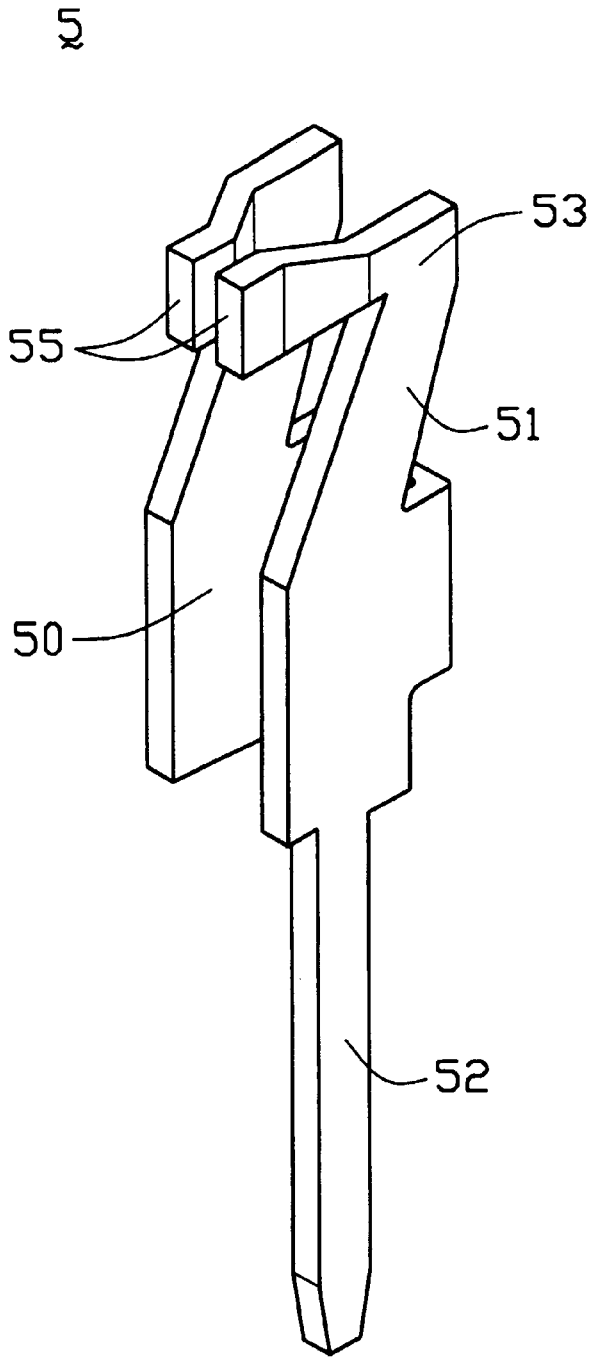
FIG. 6 (PRIOR ART)
FIG. 6 is a perspective view of a conventional contact for a CPU socket connector.

Referring to FIG. 5, a contact 1' for a CPU socket connector in accordance with a second embodiment of the present invention is essentially similar to the contact 1 of the first embodiment. Numerals in FIG. 5 which are similar to numerals in FIG. 1 designate elements in FIG. 5 which are similar to elements in FIG. 1. The contact 1' includes a base 10', a pair of arm sections 20', and a soldering section 14'. The base 10' forms a body section 12' without an element like the head section 11 of the contact 1. Such a design eliminates a possibility of the pin 3 interfering with a head section 11 of the contact 1' while the pin 3 is being inserted into the contact 1'. The arm sections 20' respectively have a pair of upper arms 21' extending perpendicularly from opposite lateral edges of the body section 12', and a pair of forearms 25' respectively extending upwardly from free ends of the upper arms 21' and beyond an upper limit of the body section 12'. A length of the forearms 25' is adjustable, for mating with pins 3 of varying lengths.

In the present invention, the contact regions are located between the palms and the forearms rather than at free ends of the palms. Thus mating force exerted by the contact regions against the pin is enhanced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact for a CPU socket connector for electrically connecting a pin of a CPU with a trace of a printed circuit board, comprising:

a base having a body section for being secured in the CPU socket connector, and a soldering section for being soldered onto the printed circuit board; and a pair of arm sections extending from opposite lateral sides of the body section; wherein the arm sections include a pair of opposite forearms extending toward each other, and a pair of palms extending from free ends of corresponding forearms and toward the body section in a manner that the palms diverge from each other as they extend toward the body section for guiding insertion of the pin.

2. The contact as claimed in claim 1, wherein the forearms extend upwardly toward each other and essentially parallel to the body section.

3. The contact as claimed in claim 2, wherein the forearms are respectively connected with the body section by a pair of upper arms.

4. The contact as claimed in claim 3, wherein the upper arms extend substantially perpendicularly from the body section.

5. The contact as claimed in claim 1, wherein the palms and the forearms are connected respectively by contact regions, the pin being clamped between the contact regions for establishing electrical connection therebetween.

6. The contact as claimed in claim 5, wherein the forearms define a first space therebetween and the palms define a second space therebetween, the first space is in communication with the second space at a channel defined by the contact regions.

7. The contact as claimed in claim 6, wherein a portion of the second space farthest away from the body section is narrower than portions of the second space closer to the body section, and a portion of the second space closest to the body section is wider than portions of the second space farther away from the body section.

8. The contact as claimed in claim 7, wherein the channel is narrower than remaining portions of the first space, and the channel is narrower than the second space.

9. The contact as claimed in claim 1, wherein the arm sections extend to a height substantially the same as a height of the base.

10. The contact as claimed in claim 9, wherein the base respectively forms at least two projections on opposite lateral sides thereof adjacent the body section, for securing the contact in the CPU socket connector.

11. The contact as claimed in claim 10, wherein the projections are formed above and below the body section.

12. The contact as claimed in claim 1, wherein the arm sections extend upwardly beyond an upper limit of the body section.

13. The contact as claimed in claim 12, wherein portions of the arm sections extending upwardly beyond the upper limit of the body section are adjustable in length, for mating with CPU pins of varying lengths.

14. A contact for a CPU socket connector for electrically connecting a pin of a CPU socket connector with a trace of a printed circuit board, comprising:

a base having a body section for being secured in the CPU socket connector, and a soldering section for being soldered onto the printed circuit board; and a pair of arm sections extending from opposite lateral sides of the body section; wherein each arm section includes an upper arm extending from the body section, a forearm connected with the upper arm, and a pair of palms extending away from the forearm toward the body section, the pair of palms gradually deviating from each other as they extend toward the body section for facilitating guiding of the pin during insertion of the pin into the contact.

15. The contact as claimed in claim 14, wherein the pair of forearms upwardly converge toward each other and respectively form contact regions at upper ends thereof, a distance between the contact regions being less than distances between identical portions of the forearms.

16. The contact as claimed in claim 15, wherein the palms connect with the respective forearms at the respective contact regions, the contact regions resiliently clamping the pin therebetween.

17. A contact for use within a passageway of a housing of a connector, comprising:

a vertical body section adapted to abut against the housing in the passageway;

a set of barbs formed on two side edges of the body section for interferential engagement with the housing;

a solder section horizontally extending from a lower edge of the body section for mounting to a printed circuit board on which the connector is seated;

a pair of upper arms respectively extending little bit downwardly from said two side edges above said barbs in a parallel relation adapted to abut against the housing, said upper arms extending beyond said solder section in a horizontal direction;

a pair of forearms respectively extending upwardly from distal ends of said pair of upper arms in a converging manner toward each other;

a pair of vertical contact regions respectively formed at upper tips of the pair of forearms in a parallel relation with each other; and a pair of palms generally horizontally extending from the pair of contact regions and commonly toward the body section while curvedly away from each other.

18. The contact as claimed in claim 17, wherein a head section coplanarly extends upward from an upper edge of the body section and another set of barbs are formed on two side edges thereof.

19. The contact as claimed in claim 18, wherein said forearms upwardly extend a distance generally flush with said head section.

20. The contact as claimed in claim 17, wherein said palms extend generally on half distance of said upper arms in the horizontal direction.

* * * * *